United States Patent [19]

Miura et al.

[11] Patent Number: 4,658,764

[45] Date of Patent: Apr. 21, 1987

[54] BOILING LIQUID ENGINE COOLING SYSTEM

[75] Inventors: Noboru Miura, Fujisawa; Yoshimasa Hayashi, Kamakura, both of Japan

[73] Assignee: Nissan Motor Co., Ltd., Yokohama, Japan

[21] Appl. No.: 770,989

[22] Filed: Aug. 30, 1985

[30] Foreign Application Priority Data

Sep. 6, 1984 [JP] Japan ..... 59-186672

[51] Int. Cl.[4] ..... F01P 3/22; F01P 5/02

[52] U.S. Cl. ..... 123/41.12; 123/41.21

[58] Field of Search ..... 123/41.11, 41.12, 41.2–41.27, 123/41.49

[56] References Cited

U.S. PATENT DOCUMENTS

| | | | |
|---|---|---|---|
| 4,313,402 | 2/1982 | Lehnhoff et al. | 123/41.12 |
| 4,367,699 | 1/1983 | Evans | 123/41.49 |
| 4,425,766 | 1/1984 | Claypole | 236/35 |
| 4,475,485 | 10/1984 | Sakakibara et al. | 123/41.12 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In a boiling liquid engine cooling system which employs an electric fan for increasing the condensation function of a radiator (or condenser), there is employed a control means which restrains the rotation speed of the electric fan to a low level at the beginning of the fan rotation and thereafter gradually increases the rotation speed to the normal level as the time proceeds. With this, undesirable sudden violent boiling of liquid coolant in the coolant jacket is prevented.

11 Claims, 6 Drawing Figures

BOILING LIQUID ENGINE COOLING SYSTEM

BACKGROUND OF THE INVENTION

1. Field of the Invention

The present invention relates in general to a so-called "boiling liquid engine cooling system" wherein the coolant is boiled, so as to make use of the latent heat of vaporization thereof, and the coolant vapor used as vehicle removing heat from the engine, and more particularly to a control system for such cooling system by which a radiator fan is controlled to suppress suddent violent boiling of coolant in the coolant jacket of the engine.

2. Description of the Prior art

Hitherto, a so-called "boiling liquid cooling system (viz., evaporative cooling system)" has been proposed for achieving cooling of an internal combustion engine. This type cooling system basically features an arrangement wherein a liquid coolant (for example, a mixture of water and antifreeze) in the coolant jacket of the engine is permitted to boil and the gaseous coolant thus produced is passed out to an air-cooled heat exchanger or radiator where the gaseous coolant is cooled or liquefied and then circulated back into the coolant jacket of the engine. A radiator fan is used for promoting the function of the radiator. Due to the effective heat exchange achieved between the gaseous coolant in the radiator and the atmosphere surrounding the radiator, the cooling system exhibits a very high performance.

However, as will become apparent as the description proceeds, the hitherto proposed cooling systems have suffered from the drawback that violent boiling of coolant in the coolant jacket tends to occur just after operation of the radiator fan. In fact, upon energization of the radiator fan, the vapor condensation ability of the radiator is instantly increased by virtue of the cooling air flow produced by the radiator fan thereby instantly reducing the pressure in the coolant jacket of the engine. This pressure drop induces a sudden violent boiling of coolant in the coolant jacket and thus forces the liquid coolant to flow into the radiator through the vapor outlet. As is known, collecting the liquid coolant in the radiator reduces the effective heat exchange area of the same and thus lowers the performance of the same.

SUMMARY OF THE INVENTION

It is therefore an object of the present invention to provide an improved boiling liquid engine cooling system which is free of the above-mentioned drawbacks.

According to the present invention, there is provided a control means for such cooling system, which restrains the rotating speed of the electric fan to a low level at the beginning of the fan rotation and thereafter gradually increases the rotation speed to the normal level as the time proceeds.

According to the present invention, there is provided a boiling liquid cooling system for an engine, which comprises means defining in the engine a coolant jacket into which coolant is introduced in liquid state and from which coolant is discharged in gaseous state, a radiator into which gaseous coolant from the coolant jacket is introduced to be liquefied, an electric pump for pumping the coolant thus liquefied by the radiator into the coolant jacket, an electric fan positioned adjacent the radiator for, upon energization, producing a radiator cooling air flow to promote the condensation function of the radiator, and control means for energizing the electric fan when the temperature of the coolant in the coolant jacket is higher than a predetermined temperature and restraining the rotation speed of the electric fan to a low level at the beginning of the fan rotation and thereafter gradually increases the rotation speed to the normal level as the time proceeds.

BRIEF DESCRIPTION 0F THE DRAWINGS

Other objects and advantages of the present invention will become apparent from the following description when taken in conjuction with the accompanying drawings, in which.

DESCRIPTION OF PRIOR PROPOSED BOILING LIQUID COOLING SYSTEM

Prior to describing in detail the invention, a prior proposed boiling liquid cooling system will be described with reference to FIG. 1 because the present invention is practically applicable to the cooling system.

Figure 1:
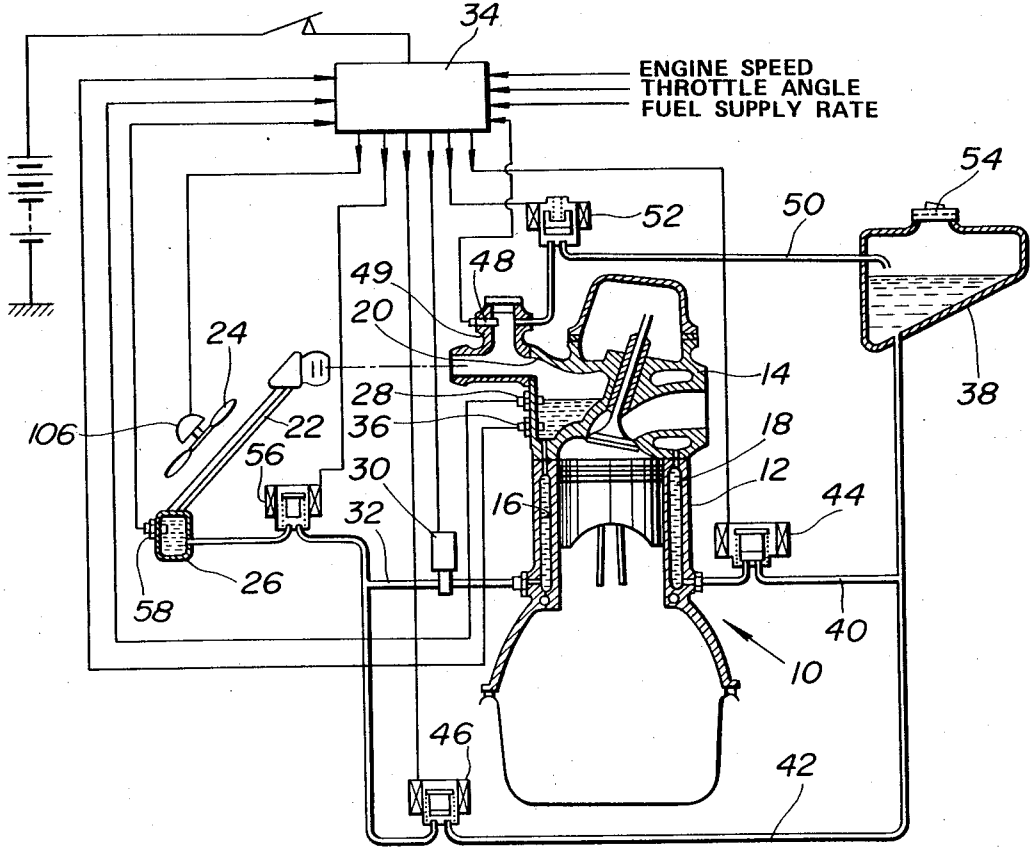
FIG. 1 is a schematical illustration of a prior proposed boiling liquid engine cooling system to which the present invention is practically applicable.

In FIG. 1, there is shown the boiling liquid cooling system associated with an internal combustion engine, which is disclosed in prior filed U.S. patent application Ser. No. 663,911 filed October 23, 1984 in the name of Yoshinori HIRANO.

The engine is generally designated by reference 10 which includes a cylinder block 12 on which a cylinder head 14 is detachably mounted. The cylinder head 14 and the cylinder block 12 include suitable cavities which define a coolant jacket 16 about the heated portions of the cylinder head and block. Contained in the coolant jacket 16 is cooling liquid (coolant) 18 which, under normal operation of the system, sufficiently covers the walls of the combustion chambers while maintaining the upper portion of the coolant jacket 16 empty of the liquid coolant, as shown. The liquid coolant boils and evaporates when heated sufficiently by combustion heat of the engine, so that under normal operation of the engine, the upper portion of the jacket 16 is filled with coolant vapor.

Fluidly communicating with a vapor discharge port 20 of the cylinder head 14 is a radiator or heat exchanger 22. It is to be noted that the interior of this radiator 22 is maintained essentially empty of liquid coolant during normal engine operation so as to maximize the surface area available for condensing the coolant vapor (via heat exchange with the ambient atmosphere) and that the cooling system as a whole (viz., the system compassed by the coolant jacket, radiator and conduting interconnecting the same) is hermetically closed when the engine is warmed-up and running. These will become clearer as the description proceeds.

Located adjacent the radiator 22 is an electrically driven fan 24 (which will be referred to as "radiator fan" herein after) which, upon energization, produces air flow passing through the radiator 22 to promote the condensation function of the same. Defined at the bottom of the radiator 22 is a small collection reservoir or lower tank 26 into which the coolant liquefied by the radiator 22 pours.

Disposed in the coolant jacket 16 is a coolant level sensor 28 which detects whether the level of the liquid coolant in the coolant jacket 16 is at a predetermined level or not. That is, when, due to the continuous evaporation in the jacket 16, the level of the liqiud coolant lowers below the predetermined level, the signal issued from the sensor 28 induces energization of an electrically driven pump 30 which is disposed in a return passage 32 which extends from the lower tank 26 of the radiator 22 to a lower portion of the coolant jacket 16 of the engine 10. Upon energization of the pump 30, the liquid coolant is introduced into the coolant jacket 16 from the lower tank 26. Actually, the operation of the pump 30 is controlled by a control unit 34 which is described in detail in the afore-mentioned prior filed U.S. patent application. With this, the coolant level in the coolant jacket 16 is kept substantially at the predetermined level during normal operation of the system.

A temperature sensor 36 is disposed also in the coolant jacket 16 in order to detect the temperature of the coolant therein. Receiving signals from the temperature sensor 36 and other sensors (not shown), such as, engine speed sensor, throttle valve angle sensor and fuel supply rate sensor, the control unit 34 controls operation of the radiator fan 24 in a manner to allow the engine proper 10 to have an optimum temperature in accordance with the operation mode thereof. Under operation of the cooling system, the cooling system as a whole is hermetically closed, so that changing the pressure in the system induces variation in the boiling point of the liquid coolant contained therein.

When, for example, the engine 10 is under low load condition wherein heat generated by the engine is relatively small, the control unit 34 controls the radiator fan 24 to produce a lower amount of air flow per unit time (in practice, the control unit 34 stops the fan 24) to lower the condensation function of the radiator 22. With this, the pressure in the system becomes higher than the atmospheric value thereby increasing the boiling point of the liquid coolant in the system to a certain value, so that the temperature of the coolant in the coolant jacket 16 can be kept at relatively high level (for example, 120 ° C.) thereby achieving reduction in thermal loss of the engine 10.

When, on the contrary, the engine is under high load condition wherein heat generated by the engine 10 is great, the control unit 34 controls the radiator fan 24 to produce a greater amount of air flow per unit time (in practice, the control unit 34 continues energization of the radiator fan 24) to promote the condensation function of the radiator 22. With this, the pressure in the system becomes lower than the atmospheric value thereby lowering the boiling point of the coolant in the system, so that the temperature of the coolant in the coolant jacket 16 can be kept at relatively low level (for example, 90° C.) thereby achieving appropriate cooling of the engine.

Since the latent heat of the coolant 18 is considerably high and the heat radiation of the coolant vapor at the radiator 22 is sufficiently high, cooling of the engine 10 can be effectively achieved with a small amount of liquid coolant. Furthermore, by the reasons as mentioned hereinabove, the temperature control of the engine 10 can be effected in accordance with the operation modes of the engine with quick response.

In order to deal with undesirable negative pressure in the system which might occur when, after stop of the engine, the temperature of the liquid coolant lowers to the atmospheric value, the following measure is employed.

A reservoir tank 38 is provided which is connected with the coolant jacket 16 of the engine 10 through conduits 40 and 42. Electromagnetic valves 44 and 46 are disposed in the conduits 40 and 42, respectively. The control unit 34 functions so that, upon stopping of the engine 10, it opens the valve 44 thereby forcing additional liquid coolant in the reservoir tank 38 to flow down to the coolant jacket 16 by the force mainly produced by the pressure difference between the interior of the system and the atmosphere. This coolant supply is continued until the coolant level in the jacket 16 rises to the level of another coolant level sensor 48 which is disposed in a riser-like portion 49 of the cylinder head 14, as shown. With this, the negative pressure in the system disappears.

In order to deal with undesirable air-contamination in the system which might occur when, due to lowering in pressure in the system, atmospheric air invades or enters the coolant jacket 16 of the engine through any incompletely sealed portion of the system, the following measure is also employed.

A conduit 50 extends from the riser-like portion of the cylinder head 14 to the reservoir tank 38 and an electromagnetic valve 52 is disposed in the conduit 50. The control unit 34 functions so that upon starting of the engine 10, it opens the valves 52 and 46 and energizes the pump 30 for a certain period of time thereby forcing the additional liquid coolant in the reservoir tank 38 to flow into the coolant jacket 16. With this, the coolant jacket 16 becomes completely filled with the liquid coolant and the latter overflows through the conduit 50 into the reservoir tank 38 together with any air in the liquid coolant and the air is discharged to the atmosphere through an air permeable cap 54 of the reservoir tank 38. During this, the valve 44 and another electromagnetic valve 56 which is disposed in the return conduit 32 are both closed.

When, with the contaminating air thus discharged, the temperature of the liquid coolant in the coolant jacket 16 increases to a certain degree by the combustion heat of the engine, the coolant in the jacket 16 starts boiling. Upon this, the valve 44 in the conduit 40 is opened in response to information signals applied thereto from a liquid level sensor 58 which is mounted to the lower tank 26 of the radiator 22, so that the coolant in the jacket 16 is obliged to boil under atmospheric pressure causing the coolant in the jacket 16, by the amount corresponding to that additionally fed to the jacket 16 from the reservoir tank 38 for the air purging, to return back to the reservoir tank 38 through the conduit 40. This coolant return operation is mainly caused by the pressure produced in the vapor space of the coolant jacket 16.

As is described in the afore-mentioned prior filed U.S. patent application, the pump 30 is controlled by the level sensor 28 so as to keep the level of the liquid coolant in the coolant jacket 16 at the predetermined level. When, however, the liquid coolant level in the lower tank 26 of the radiator 22 lowers to the level of the level sensor 58 mounted thereto, operation of the pump 30 stops irrespective of nature of the signals issued from the level sensor 28 of the coolant jacket 16.

With the arrangement and operation described hereinabove, the boiling liquid cooling system can exhibit its excellent cooling performance over wide operation modes of the engne 10. Since the cooling work of the system can be effectd with a small amount of liquid coolant, the sizes and capacities of the coolant jacket 16, the radiator 22 and the electric pump 30 can be reduced, which induces "small-sized and light-weight" construction of the cooling system. Furthermore, warm up of the engine 10 can be completed in a shortened time and, due to the excellent heat exchange carried out at the radiator 22, operation of the radiator fan 24 can be economized. That is, the time for which the radiator fan 24 operates practically can be shortened.

DRAWBACKS ENCOUNTERED IN THE PRIOR PROPOSED SYSTEM

However, the boiling liquid cooling system as mentioned hereinabove has suffered from the drawback that the liquid coolant in the coolant jacket 16 tends to boil violently just after operation of the radiator fan 24. That is, upon energization of the fan 24, the vapor condensation ability of the radiator 22 is instantly increased thereby to instantly reduce the pressure in the coolant jacket 16 bringing about a sudden violent boiling of the liquid coolant in the coolant jacket 16. The violent boiling in the coolant jacket 16 tends to force the liquid coolant in the jacket 16 to flow or jump into the radiator 22 thereby to reducing the effective heat exchanging surface area of the same. Thus, the vapor condensation ability of the radiator 22 is thereafter lowered considerably. Furthermore, this coolant jump-in phenomenon induces lack of liquid coolant in the coolant jacket 16 thereby inducing frequent energization of the coolant feed pump 30 for keeping the coolant level in the jacket 16 at the predetermined sufficient level. As is known, the frequent energization of pump 32 causes considrable consumption of electric power. With these reasons, satisfactory cooling has not been provided from such prior proposed boiling liquid cooling system.

DETAILED DESCRIPTION OF THE INVENTION

In order to eliminate the above-mentioned undesirable phenomenon, the present invention provides an improved control system of such cooling system, by which the radiator fan 24 is controlled so that, upon energization, the rotating speed thereof is restrained at a relatively low speed at the beginning of the fan rotation and thereafter gradually increased to the normal operation level as the time proceeds.

Figure 2:
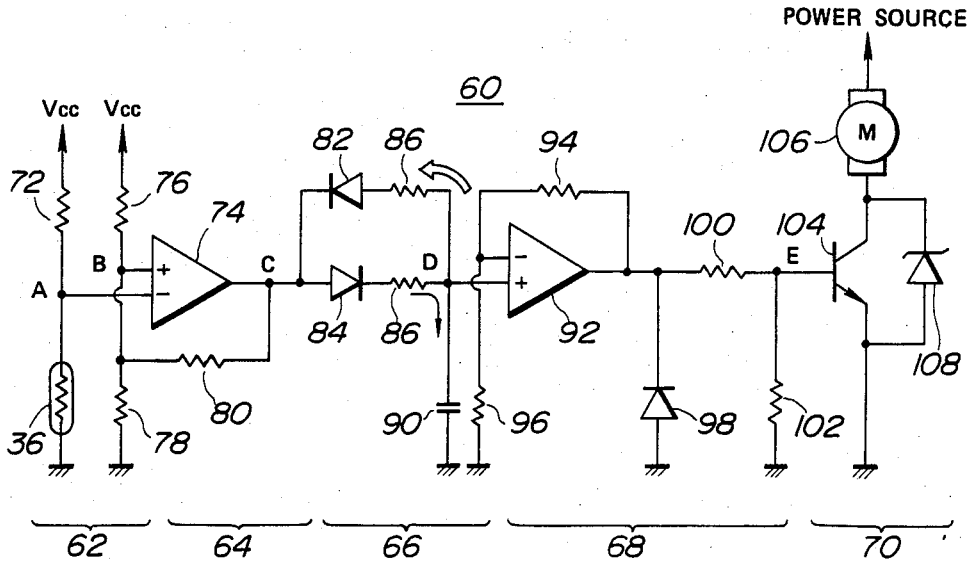
FIG. 2 is an electric circuit employed in a first embodiment of the present invention.

Referring to FIG. 2, there is shown a control system 60 employed in a first embodiment of the present invention, which is included in the control unit 34 to control the radiator fan, viz., the electric motor 106 (see FIG. 1) thereof.

The control system 60 comprises generally a temperature detecting circuit 62, a comparator circuit 64, a charge and discharge circuit 66, an amplification circuit 68 and a driving circuit 70.

The temperature detecting circuit 62 comprises first and second voltage dividers, each being applied with a constant voltage "Vcc". The first voltage divider consists of a resistor 72 and a thermistor (viz., the temperature sensor 36), while the second voltage divider consists of resistors 76 and 78. The potentials at the points "A" and "B" of the first and second voltage dividers are applied to first and second inputs of the comparator 74 of the comparator circuit 64. With this, the comparator 74 is applied with a variable voltage from the first voltage divider and a reference voltage from the second voltage divider.

The comparator circuit 64 is provided with a resistor 80 to possess a hysteresis function. When the potential at the point "A" becomes lower than that at the point "B", that is, when the temperature of the coolant in the coolant jacket 16 becomes higher than the predetermined temperature, the comparator issues a signal "C", and when the coolant temperature becomes lower than the predetermined temperature by a degree determined by the resistor 80, the comparator 74 stops issuing the signal "C".

The signal "C" is applied to the charge and discharge circuit 66 which comprises parallelly arranged diodes 82 and 84, resistors 86 and 88 respectively connected to the diodes 82 and 84 in series and a condenser 90. The diodes 82 and 84 are arranged in a reversed relationship as shown. The resistance of the resistor 88 is greater than that of the other resistor 86. The potential at the point "D" is applied to an input of a non-inversion amplifier 92 of the amplification circuit 68. At the beginning of issue of the signal "C" from the comparator 74, the condenser 90 is charged, so that as is seen from FIG. 3, a signal having a gently rising slope is applied to the non-inversion amplifier 92. When, however, the signal "C" disappears, the condenser 90 is quickly discharged through the series connected diode 82 and the resistor 86, so that the signal "D" disappears.

The non-inversion amplifier 92 amplifies the signal "D" at a rate determined by two resistors 94 and 96 connected to an input of the amplifier 92. The signal "E" thus produced by the non-inversion amplifier 92 is applied via a diode 98 and two resistors 100 and 102 to a power transistor 104 of the driving circuit 70. The diode 98 is used for suppressing any generation of negative signals and the resistors 100 and 102 are used for smoothing the signal "E".

The power transistor 104 is installed in a circuit which connects an electric power source with the electric motor 106 of the radiator fan 24. In accordance with the intensity of the signal "E", the power transistor 104 controls the current applied to the electric motor 106. A diode 108 is connected to the circuit to absorb surge current.

Figure 3:
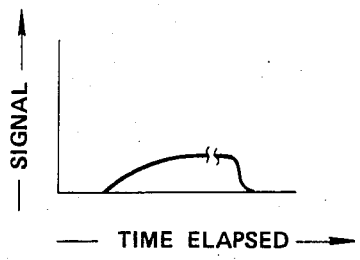
FIG. 3 is a graph showing the characteristics of a signal applied to a part of the electric circuit of FIG. 2.
Figure 4:
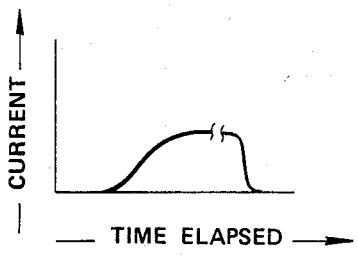
FIG. 4 is a graph showing the characteristics of a current provided by the electric circuit of FIG. 2.

When, in operation, the coolant temperature detected by the temperature sensor 36 (thermistor) becomes higher than the predetermined temperature determined by the second voltage divider of the resistors 76 and 78, the comparator circuit 64 issues a signal "C", and the rising of this signal "C" is treated by the charge and discharge circuit 66 in a manner as shown in FIG. 3. The signal "D" thus produced by the charge and discharge circuit 66 is amplified by the amplification circuit 68 to produce an amplified signal "E" and applied to the power transistor 104 of the driving circuit 70. Thus, the electric motor 106 of the radiator fan 24 is applied with a current the rising of which is gentle as shown in FIG. 4.

Thus, upon energization, the electric motor 106 of the radiator fan 24, viz., upon sensing the coolant temperature being higher than the predetermined degree, the rotating speed of the fan 24 is restrained at a low speed at the beginning of the fan rotation and gradually increased to the normal level as the time proceeds. Accordingly, the sudden violent boiling of the coolant, which would occur at the beginning of the fan rotation in the afore-mentioned prior proposed cooling system, is not caused. Thus, the undesirable liquid coolant flow to the radiator due to the sudden violent coolant boiling is prevented, so that the heat exchange efficiency of the radiator 22 is kept high throughout the operation of the cooling system. Furthermore, the undesirable frequent energization of the coolant feed pump 30, which would occur in the prior proposed system due to lack of the coolant in the coolant jacket 16, is not caused.

When the coolant temperature in the coolant jacket 16 becomes lower than the predetermined temperature by a degree determined by the resistor 80, the signal "C" from the comparator circuit 64 and thus the signal "D" from the charge and discharge circuit 66 disappear, so that the power transistor 104 shuts off the connection between electric motor 106 and the electric power source thereby stopping the radiator fan 26. Thus, over cooling of the cooling system is prevented.

Figure 5:
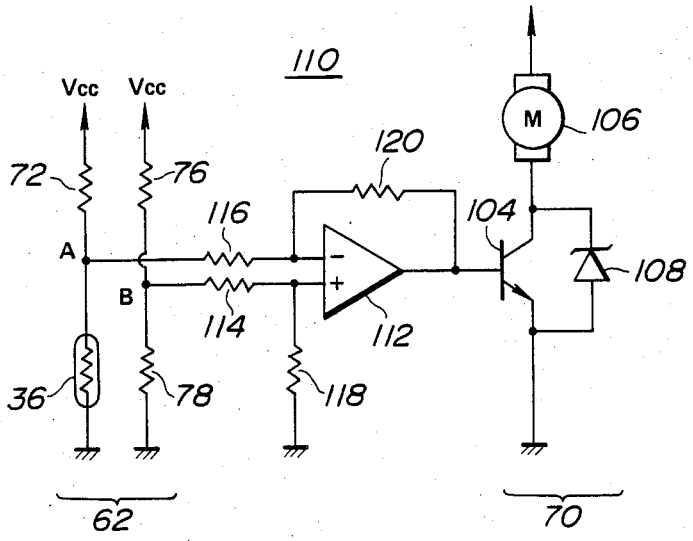
FIGS. 5 and 6 are electric circuits employed in second and third embodiments of the present invention.

Referring to FIG. 5, there is shown a control system 110 employed in a second embodiment of the present invention. The control system 110 comprises a temperature detecting circuit 62 and a driving circuit 70 which are identical to those in the first embodiment of FIG. 2. In addition to these, the control system of the second embodiment has a differential amplifier 112 which functions to amplify the difference between the potentials at the point "A" and "B" of the temperature detecting circuit 62 and control the power transistor 104 in accordance with the potential difference. That is, when the potential at the point "A" is lower than that at the point "B", the amplifier 112 amplifies the difference between these potentials at a rate determined by the resistors 114, 116, 118 and 120 connected thereto. The amplified difference signal from the amplifier 112 is applied to the power transistor 104.

Accordingly, when the coolant temperature is lower than the predetermined temperature (viz., when the potential at the point "A" is higher than that at the point "B"), the power transistor 104 is not actuated. However, when the coolant temperature becomes higher than the predetermined temperature, the current applied to the electric motor 106 of the radiator fan 26 is gradually increased as the potential difference increases. With this arrangement, gentle acceleration of running of the radiator fan 26 is achieved because it never occurs that the temperature of the coolant in the coolant jacket 16 rapidly changes. Furthermore, in this second embodiment, the rotation speed of the radiator fan 26 is controlled in accordance with the temperature of the coolant 18.

Figure 6:
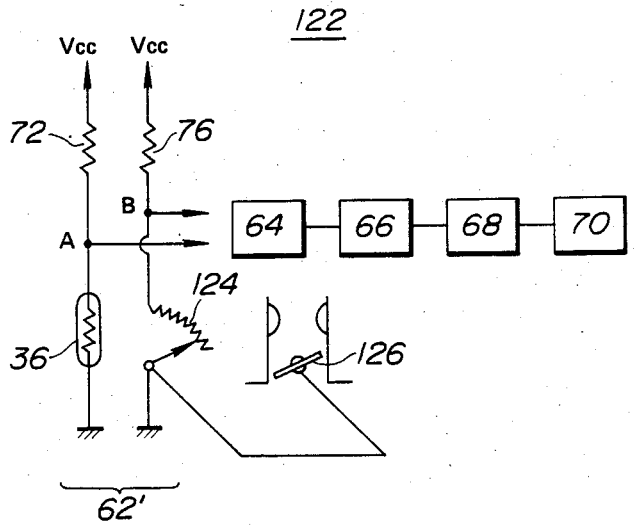

Referring to FIG. 6, there is shown a control system 122 employed in a third embodiment of the present invention. The control system 122 is substantially the same as the control system 60 of the first embodiment, except for the temperature detecting circuit. The temperature detecting circuit 62' employed in this third embodiment has a variable resistor 124 in the second voltage divider, as shown. That is, the variable resistor 124 is arranged to vary its resistance in accordance with the angular position of a throttle valve 126 of the associated engine 10. Thus, in this third embodiment, the predetermined temperature of the coolant, viz., the target temperature at which the engine 10 is cooled can be easily controlled in accordance with the engine operation mode.

What is claimed is:

1. A boiling liquid cooling system for an engine, comprising:

means defining in the engine a coolant jacket into which coolant is introduced in liquid state and from which coolant is discharged in gaseous state;

a radiator into which gaseous coolant from said coolant jacket is introduced to be liquified;

an electric pump for pumping the coolant thus liquified by said radiator into said coolant jacket;

an electric fan positioned adjacent said radiator for, upon energization, producing a radiator cooling air flow to promote a condensation function of said radiator; and control means for energizing said electric fan when the temperature of the coolant in said coolant jacket is higher than a predetermined temperature, for controlling the rotation speed of said electric fan by gradually increasing the rotation speed from a low level at the beginning of the fan rotation to a normal level as time proceeds and for deenergizing said electric fan when the temperature of the coolant in said coolant jacket is lower than the predetermined temperature.

2. A boiling liquid cooling system as claimed in claim 1, in which said control means comprises:

a temperature detecting circuit arranged to output a signal the intensity of which is variable in accordance with the temperature of the coolant in said coolant jacket;

a driving circuit for driving said electric fan upon receiving an instruction signal applied thereto; and a signal treating circuit for treating the signal issued from said temperature detecting circuit to provide said instruction signal applied to said driving circuit.

3. A boiling liquid cooling system as claimed in claim 2, in which said temperature detecting circuit comprises:

a first voltage divider applied with a constant voltage and consisting of a first resistor and a thermistor, said thermistor being arranged in said coolant jacket; and a second voltage divider applied with the constant voltage and consisting of second and third resistors;

wherein a first potential at the point between said first resistor and said thermistor and a second potential at the point between said second and third resistors are applied to said signal treating circuit.

4. A boiling liquid cooling system as claimed in claim 3, in which said driving circuit comprises:

a power transistor which is arranged to vary the intensity of current applied to said electric fan in accordance with the intensity of the instruction signal applied thereto; and a diode connected to said power transistor to absorb surge current applied to the same.

5. A boiling liquid cooling system as claimed in claim 4, in which said signal treating circuit comprises:

a comparator which receives said first and second potentials possessed by said temperature detecting circuit and issues a signal when said first potential is lower than said second potential;

a charge and discharge circuit which is arranged to be charged at the beginning of issue of said signal and discharged quickly upon disappearance of said signal from said comparator; and a non-inversion amplifier which amplifies a signal produced by said charge and discharge circuit to provide an amplified signal which is to be applied to said power transistor of said driving circuit.

6. A boiling liquid cooling system as claimed in claim 5, in which said comparator is equipped with a resistor to possess a hysteresis function.

7. A boiling liquid cooling system as claimed in claim 6, in which said charge and discharge circuit comprises:

parallelly arranged first and second diodes, one diode being oriented opposite to the other;

two resistors respectively connected to said first and second diodes in series; and a condenser connected to the junction portion of said two resistors.

8. A boiling liquid cooling system as claimed in claim 7, in which said non-inversion amplifier is equipped with two resistors which determine the rate at which said non-inversion amplifier amplifies the signal issued from said charge and discharge circuit.

9. A boiling liquid cooling system as claimed in claim 8, in which said non-inversion amplifier further comprises a diode arranged to suppress generation of any negative elements in the signal applied to said power transistor, and two resistors arranged to smooth the signal applied to said power transistor.

10. A boiling liquid cooling system as claimed in claim 5, in which said signal treating circuit comprises:

a differential amplifier which is arranged to amplify the difference between said first and second potentials possessed by said temperature detecting circuit; and four resistors which are arranged to determine the rate at which said difference amplifier amplifies said difference.

11. A boiling liquid cooling system as claimed in claim 9, in which said third resistor of said second voltage divider of said temperature detecting circuit is a variable resistor which is arranged to vary its resistance in accordance with the angular position of a throttle valve of an associated engine.

* * * * *